US007033402B2

(12) United States Patent
Saravanabhavan et al.

(10) Patent No.: US 7,033,402 B2
(45) Date of Patent: Apr. 25, 2006

(54) TRANSPOSED PROCESS FOR MAKING LEATHER

(75) Inventors: Subramani Saravanabhavan, Adyar (IN); Palanisamy Thanikaivelan, Adyar (IN); Jonnalagadda Raghava Rao, Adyar (IN); Bangaru Chandrasekaran, Adyar (IN); Balachandran Unni Nair, Adyar (IN); Thirumalachari Ramasami, Adyar (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/817,043

(22) Filed: Apr. 2, 2004

(65) Prior Publication Data

US 2005/0138738 A1 Jun. 30, 2005

Related U.S. Application Data

(63) Continuation of application No. PCT/IB03/06188, filed on Dec. 25, 2003.

(51) Int. Cl.
*C14C 3/28* (2006.01)
*C14C 1/00* (2006.01)
*D06P 3/32* (2006.01)

(52) U.S. Cl. ..... 8/436; 8/94.2; 8/94.22; 8/94.33; 8/404

(58) Field of Classification Search ..... 8/94.15, 8/94.16 R–94.33, 436
See application file for complete search history.

(56) References Cited

U.S. PATENT DOCUMENTS 5,464,451 A * 11/1995 Denny et al. ..... 8/94.21
5,620,748 A * 4/1997 Birkhofer et al. ..... 427/389

OTHER PUBLICATIONS

Saravanabhavan et al. (2003) "Green solution for tannery pollution: effect of enzyme base lime-free inhairing and fibre opening in combination with pickle-free chrome tanning", Green Chemistry 5: 707-714.
Thanikaivelan et al. (2003) "Stepping into third millenium: third generation leather processing—a three step tanning technique", Journal of the American Leather Chemists Association 98: 173-184.
Thanikaivelan et al. (2001) "Development of leather processing method in narrow ph profile: Part. 2. Standardisation of tanning process", Journal of the Society of Leather Technologists and Chemists 85: 106-115.
Thanikaivelan et al. (2000) "Development of leather processing method in narrow ph profile: Part. 1. Standardisation of dehairing process", Journal of the Society of Leather Technologists and Chemists 84:276-284.
Rao et al. (1999) "Surveillance of chromium tanning: A Revisit," Science and technology for leather into the next millennium, Proceedings of the XXV International Union for Leather Technologists and Chemists Societies Congress p. 295-301.
Covington et al. (1983) "A prctical chrome recovery system using magnesium oxide", Journal of the Society of Leather Technologists and Chemists 67: 5-12.
Herfeld et al. (1975) "Fachzeitschrift für die chemie und technologie der lederherstellung mittellungsblatt des verelnsfür gerberel-chemie und -technik E.V.", Das Leder 26: 117-128.
Aloy et al., Tannery and Pollution, Centre Technique Du Cuir, Lyon, France, May 1976, section 1.1.3, 1.1.4, 1.1.4.1.
Bienkewicz, Physical Chemistry of Leather Making, 12.1: Soaking, Krieger Publishing, Malabar, FL, 1983.
Germann, The Ecology of Leather Production:Present State and Development Trends, paper presented at 1999 International Union of Leather Technologist and Chemists Societies (IULTCS) Meeting.
Chandrasekaran, An Approach Towards Better Exhaustion of Chrome in Tanning, Leather Science, 34: 91, 1987.
Venba et al., Pickle Less High Exhaust Chrome Tanning Process, poster presented at 30th Leather Research and Industry Get-Together (LERIG), Chennai, India, 1995.
Simoncini and Sammarco, The Possibility of Reducing the COD Deriving From the Fatliquoring of the Softly Leathers in Residual Baths, Proceedings of the XXIII International Union for Leather Technologists and Chemists Societies Congress, Germany, 1995.

* cited by examiner

*Primary Examiner*—Margaret Einsmann
(74) *Attorney, Agent, or Firm*—Baker Botts LLP

(57) ABSTRACT

The present invention relates to a novel leather making process whereby the post-tanning wet operations are done prior to tanning stage itself to make leather in eco-friendly manner in substantially shorter duration. The present process reduces the number of required steps for leather processing and the pollution load generated in comparison to conventional leather processing.

16 Claims, 2 Drawing Sheets

*Assuming the skins are shaved and in the case of hides, they are split and shaved to required thickness.

Total requirement
Water 17760 L
Time 5.35-6.15 days
Power 460-1030 kWh

If the splits are also post tanned, then the total requirement would be

Total requirement
Water 19920 L
Time 5.75-6.95 days
Power 725-1580 kWh

TRANSPOSED PROCESS FOR MAKING LEATHER

CROSS-REFERENCE TO RELATED APPLICATIONS

This is a continuation of International Application No. PCT/IB2003/06188, filed Dec. 25, 2003, which is incorporated by reference herein in its entirety.

FIELD OF THE INVENTION

The present invention relates to a novel leather making process, whereby the post-tanning wet operations are done prior to tanning stage itself to make leather in eco-friendly manner within a substantially shorter duration. There is enormous potential application in the leather industry for making leathers with desired softness and grain smoothness, where the pollution load generated would be significantly less than the pollution load generated by conventional leather processing processes.

BACKGROUND OF THE INVENTION

Conventional leather processing involves four important operations, viz., pre-tanning, tanning, post-tanning and finishing. It includes a combination of single and multi-step processes that employs, as well as expels, various biological, organic and inorganic materials as described by Germann (Science and Technology for Leather into the Next Millennium, Tata McGraw-Hill Publishing Company Ltd., New Delhi, p. 283, 1999). Conventional methods of leather processing typically involve 14–15 steps, comprising soaking, liming, reliming, deliming, bating, pickling, chrome tanning, basification, rechroming, basification, neutralization, retanning, dyeing, fat liquoring and fixing. Liming and reliming processes employ lime and sodium sulfide. These two processes purify the skin matrix by the removal of hair, flesh and other unwanted materials to produce pelt. The deliming process employs quaternary ammonium salts for neutralizing the alkalinity. The bating process purifies the skin matrix further by using pancreatic enzymes. The pickling process prepares the skin for subsequent tanning. The tanned skin matrix may be further retanned to gain substance, fat liquored to attain required softness and dyed to preferred shades. The conventional technique discharges enormous amount of pollutants, which accounts for nearly 98% of the total pollution generated from a tannery as analyzed by Aloy et al (Tannery and Pollution, Centre Technique Du Cuir, Lyon, France, 1976). The pollution includes biochemical oxygen demand (BOD), chemical oxygen demand (COD), total dissolved solids (TDS), sulfides, chlorides, sulfates, chromium, etc. This is primarily due to the fact that the conventional leather processing employs 'do-undo' process schemes, such as swell-deswell (liming-deliming); pickle-depickle (pickling-basification), rechroming-basification (acidification-basification) and neutralization-fixing (basification-acidification) as described by Bienkewicz (Physical Chemistry of Leather Making, Krieger Publishing, Malabar, Fla., 1983). In other words, conventional methods employed in leather processing subject the skin or hide to wide variations in pH. Such pH changes require the use of acids and alkalis, and lead to the generation of salts. This results in a net increase in COD, TDS, chlorides, sulfates and other minerals in tannery wastewaters as reported by Thanikaivelan et al (Journal of the Society of Leather Technologists and Chemists, 84, 276, 2000).

Conventional chrome tanning generally involves pickling, tanning using basic chromium sulfate (BCS), followed by basification processes. Spent pickle liquor has a high dissolved solid content and a considerable amount of chemical oxygen demand, since pickling involves the use of 8–10% sodium chloride salt along with sulfuric acid as reported by Aloy et al (Tannery and Pollution, Centre Technique Du Cuir, Lyon, France, 1976). The use of non-swelling acids in pickling has been reported by Herfeld and Schubert (Das Leder, 26, 117, 1975) in order to reduce total dissolved solids. Several better chrome management methods have been developed, for example, high exhaust chrome tanning as reported by Chandrasekaran (Leather Science, 34, 91, 1987); pickle-less tanning as given by Venba et al (Poster presented at $30^{th}$ Leather Research and Industry Get-together, Chennai, 1995); chrome recovery and reuse as reported by Covington et al (Journal of the Society of Leather Technologists and Chemists, 67, 5, 1983); and closed pickle-tan loop system as described by Rao et al (Science and technology for leather into the next millennium, Proceedings of the XXV International Union for Leather Technologists and Chemists Societies congress, p. 295, 1999). The conventional method of post-tanning process involves 7–8 major steps comprising rechroming, basification, neutralization, washing, retanning, dyeing, fat liquoring and fixing. The post-tanning operation employs a pH range of 4.0–7.0 and a variety of chemicals. The post-tanning processes contribute to TDS, COD and heavy metal pollution as analyzed by Simoncini and Sammarco (Proceedings of the XXIII International Union for Leather Technologists and Chemists Societies congress, Germany, 1995). Post-tanning chemicals generally contribute to COD in large measure and this can be mitigated by the use of optimized quantities of high performing auxiliaries, which would lead to less discharge of bio-treatable residues. Selection of retanning and fat liquoring agents is based on their biodegradability and uptake behavior. However, these improvements are specific to a unit operation. Implementation of all the advanced technologies and eco-friendly chemicals involves financial input and machinery requirements as well. This calls for the development of integrated leather processing technology and reorganization of various steps in leather processing. Very few attempts have been made to reorganize the sequence of the leather processing steps. Thanikaivelan et al. have attempted to make leather in a narrow pH range from 4.0–8.0 (Journal of the Society of Leather Technologists and Chemists 84, 276, 2000; 85, 106, 2001). Thanikaivelan et al have developed a biochemically based three step tanning process in the pH range of 4.0–8.0 (Journal of the American Leather Chemists Association 98, 173, 2003). The three-step tanning process involves dehairing at pH 8.0 without employing lime, sodium hydroxide based fiber opening and pickle-less chrome tanning at pH 8.0. Saravanabhavan et al. have successfully developed a three step tanning method, which involves dehairing without employing lime and sodium sulfide, enzyme based fiber opening and chrome tanning at pH 8.0 (Green Chemistry 5, 2003, 707). However, no attempts have been made to swap the leather processing steps. The above-mentioned references disclose processes that are preliminary to prime tanning. Subsequently, the prior art processes require conventional post-tanning processing, involving 7–8 major steps comprising rechroming, basification, neutralization, washing, retanning, dyeing, fat liquoring and fixing.

The main objective of the present invention is to provide a novel transposed process for making leather.

Another object of the invention provides a novel transposed process, wherein the process does not require pickling and basification steps.

Yet another object of the present invention provides a transposed process wherein the post-tanning process does not require acid washing, rechroming, neutralization, washing and fixing.

Still another object of the present invention is directed to a transposed process that leads to significant reduction in chemical oxygen demand, total solids load and other pollution loads.

One more object of the present invention provides an inventive step in treating untanned pelts with syntans, fat liquors and dyes, which are conventionally considered as post-tanning wet processing chemicals, thereby providing an eco-friendly option for leather processing.

SUMMARY OF THE INVENTION

The present invention relates to a novel transposed process for making leather, which precludes the drawbacks stated above. The present invention provides a tanning process that does not require pickling and basification steps. Furthermore, the post-tanning process does not require acid washing, rechroming, neutralization, washing and fixing. Thus, the leather obtained through the process of the present invention produces leathers that possess characteristics matching the characteristics of leathers produced from conventional leather processing steps. The transposed process results in significant reduction in chemical oxygen demand, total solids load and other pollution loads. The presently claimed process reduces the number of steps from the conventional process, making the process into more compact by reversing the process sequence. Additional advantages of the disclosed process include the reduction in pollutant, certain chemicals, water usage, power and time required to produce tanned leather products.

DETAILED DESCRIPTION OF THE INVENTION

Figure 1A:
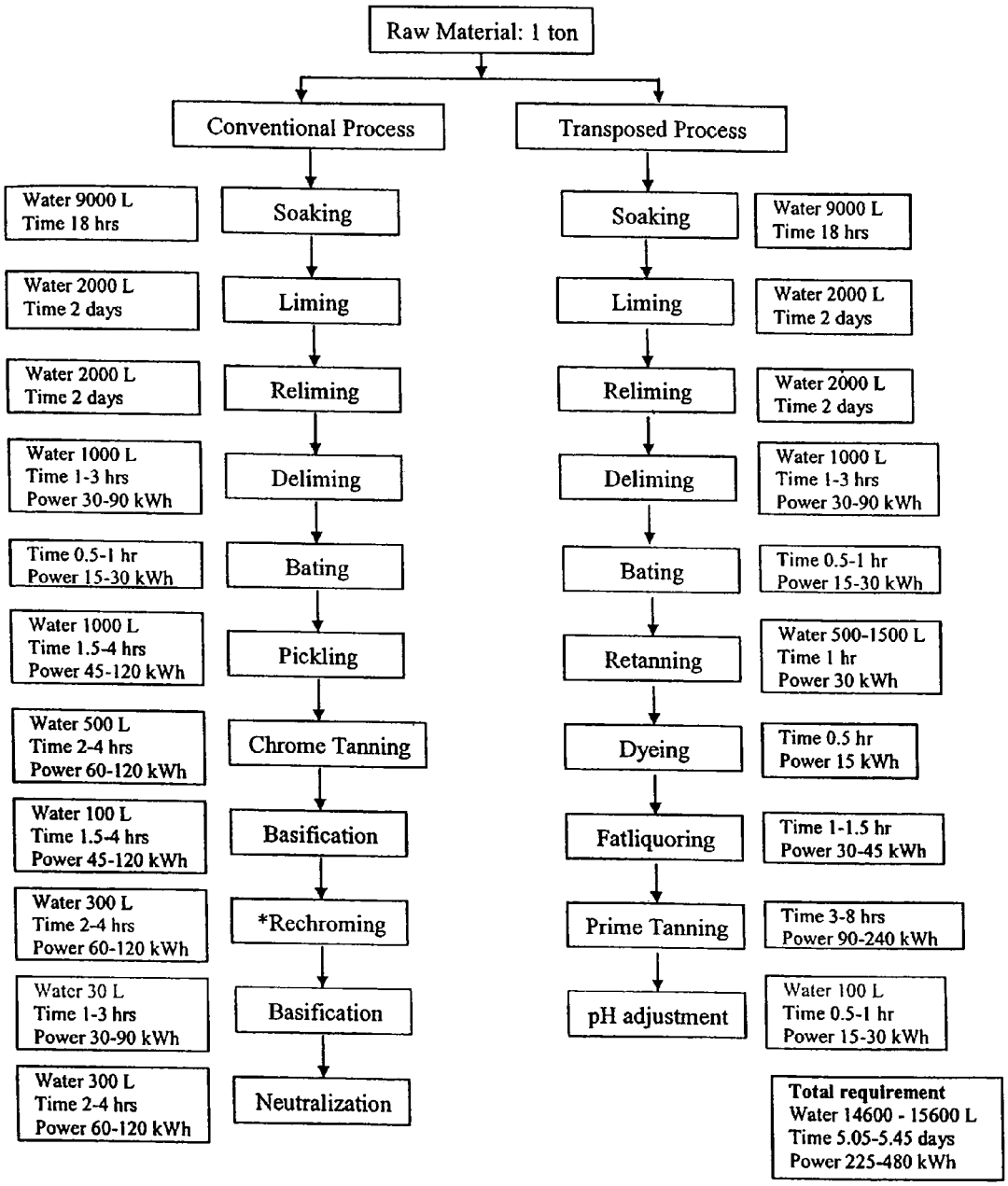
FIGS. 1A and 1B show a flowchart comparing conventional and transposed leather processing.
Figure 1B:
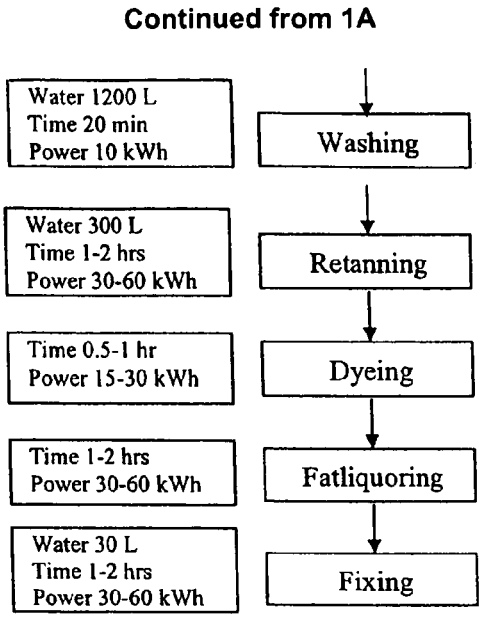

The present invention relates to a novel transposed process for making leather. The present invention provides a tanning process that does not require pickling and basification steps. Furthermore, the post-tanning process does not require acid washing, rechroming, neutralization, washing and fixing. The leather obtained through the process of the present invention produces leathers that possess characteristics matching the characteristics of leathers produced from conventional leather processing steps. The transposed process results in a significant reduction in chemical oxygen demand, total solids load and other pollution loads. Untanned pelts are treated with syntans, fat liquors and dyes, which are conventionally considered as post-tanning wet processing chemicals. The process described herein provides an eco-friendly option for leather processing. Syntans are synthetic tanning agents, based on organic chemicals, which are used to fill the leather. Luganil FBO, Sandopel Brown BSI, Dermapel blue IDBN and Sellafast orange-CGL are examples of dyes that may be used. The present process reduces the number of steps from the conventional process, making the process more compact by reversing the tanning process sequence. The process eliminates some of the processing steps and hence excess usage of chemicals. However, the nature and concentration of chemicals used in the present process are the same as those used for the conventional process. The present process results in reduction of pollutant, certain chemicals, water usage, power and time (Tables 1 and 2; FIG. 1).

Accordingly, the present invention relates to a novel transposed process for making leather, said process comprising:

(a) treating delimed and/or bated pelt with fat liquor in the range of 2–6% w/w (weight of fat liquor to weight of pelt) at a pH in the range of 5.0–8.5 and at a temperature in the range of about 20–55° C., optionally along with a synthetic tanning agent in the range of 1–6% w/w (weight of synthetic tanning agent to weight of pelt), (b) stirring for a period of about 3 hrs to obtain a fat liquored pelt, (c) mixing a tanning agent in the range of 4–25% w/w (weight of tanning agent to weight of pelt) at a pH in the range of 5.0–8.5 in the fat liquored pelt of step (b) optionally along with a complexing agent, and adjusting the pH of the resulting stock of step (c) in about 3 hrs to a range of 3.5–4.5 by a conventional method to get wet processed leather.

In another embodiment of the present invention, the synthetic tanning agent of step (a) is syntan, wherein the syntan is selected from the group consisting of acrylic, phenol condensates, urea condensates, sulfones, melamine, protein condensates, either alone or in any combination.

In another embodiment of the present invention, the dye is an acid or a metal complex, used alone or in combination.

In another embodiment of the present invention, the fat liquor is selected from the group consisting of vegetable, synthetic and semisynthetic fat liquors, wherein the fat liquor is used either alone or in any combination.

In yet another embodiment of the present invention, the tanning agent is selected from group consisting of basic chromium sulfate, vegetable tannins, aluminum syntan and chromium-silica.

The complexing agent is selected from the group consisting of polymeric syntan and acrylic syntan.

In an embodiment of the present invention, the percentage addition of fat liquor in step (a) is based on the weight of fleshed pelt.

In another embodiment of the present invention, the percentage of tanning agent is based on the weight of the fleshed pelt obtained from the step (a).

The dye in step (a) is present in about 2% w/w (weight of dye to weight of pelt). Alternatively, the dye is present in about 1% w/w (weight of dye to weight of pelt).

In another embodiment of the present invention, the complexing agent is present in about 2% w/w (weight of complexing agent to weight of pelt), preferably about 1% w/w (weight of complexing agent to weight of pelt).

The process of preparing the leather products of the present invention may be performed in about 6–10 hrs.

The present process produces a leather product having higher softness, fullness and grain tightness than a leather product produced using conventional processes in the range of 8.5±2.

Furthermore, the present invention produces a leather product having higher softness, fullness and grain tightness than a leather product obtained using conventional processes in the range of 8.2±2.

EXAMPLES

Example 1

The present example was disclosed in U.S. patent application Ser. No. 10/618,997, filed Jul. 14, 2003, incorporated herein by reference.

534 gms of anthracene and 326 ml of concentrated sulfuric acid were added to a 2 liter round bottom flask fitted with a stirrer. The contents of the flask were heated to 140° C. for 90 minutes with continuous stirring. 1 ml of the mass was placed in a beaker and 3 ml water was added with shaking. It was observed to form a clear solution without a free naphthalene smell, confirming the completion of sulfonation. The sulfonated mass was transferred to a reactor fitted with a thermometer, stirrer and a dropping funnel. The mass was stirred continuously for a period of 10 min. while maintaining the temperature at 80° C. A mixture of 5.4 gms oxalic acid, 4.14 gms salicylic acid and 10 gms phthalic acid dissolved in 50 ml water was added to the above sulfonated mass and stirring was continued at 80° C. 1.5 gms of polymethacrylic acid was added to the sulphonic acid mixture and the mixture was heated to 80° C. for 1 hour. A small portion of the reaction mixture was transferred to a beaker and 2 ml water was added to the mass. The pH of the solution in the beaker was adjusted to 3 and a clear solution was obtained, indicating the completion of the reaction. About 540 ml of water was added to the mass and transferred to a bucket after cooling the reaction mass to room temperature. The pH of the mass was raised to 3 by adding a solution of 220 gms of sodium hydroxide in 500 ml water, followed by the addition of an aqueous solution of 200 gms of sodium carbonate in 400 ml water. The slurry was aerated for 45 minutes conventionally and filtered using a cloth of pore size 5–10μ. The filtrate was spray dried at 260° C. and the white powder obtained was stored in a plastic container. The prepared syntan was added to delimed sheepskins at 1.0% w/w (weight of syntan to weight of pelt) along with 5% basic chrominum sulfate (BCS) w/w (weight of BCS to weight of pelt) at a float of 20% v/w (volume of water to weight of pelt) in a small tanning drum. The drum was run for 1 hr and 80% water v/w (volume of water to weight of pelt) was added. The drum was run for another 1 hr and penetration of the tanning chemicals into the skins was assessed by checking uniform blue color along a cut section. The pH of the solution and the cut section was found to be 4.4. The bath was drained and the wet blue leathers were piled. On the next day, the leathers were post-tanned using a conventional garment leather processing recipe. The chromium exhaustion of the spent tan liquor was found to be 95%. The fullness of the crust leathers was found to be superior to that of conventional chrome tanned leathers.

Example 2

Five bated goatskin pelts having fleshed pelt weight of 4.6 kgs were placed in a small experimental tanning drum. The cross section pH of the bated pelts was found to be 8.0.

The bated pelts were washed with 9.2 l water for 10 minutes and drained. A combination of syntans, 23 gms of Basyntan DI (phenolic condensed product from Badische Anilin-& Soda-Fabrik AG (BASF)), 23 gms of Vernatan OS (phenolic condensed product from Colour-Chem Limited, India), 46 gms of Basyntan FB6 (urea melamine based product from BASF) and 46 gms of Relugan RE (copolymer based product from BASF) along with 6.9 l water was added simultaneously to the drum. The drum was run for 1 hr. 4.6 gms of Luganil FBO (acid dye from BASF) were added. The drum was run for 30 minutes. Then, an emulsion comprising a combination of the fat liquors, 46 gms of Vernol liquor PN (natural oil based product from Colour-Chem Ltd.), 46 gms of Vernol liquor ASN (synthetic fat liquor from Colour-Chem Ltd.) and 46 gms of Balmol SX-20 (synthetic fat liquor from Balmar Lawrie & Co. Ltd.) in 460 ml of hot water at 50° C. was added. The drum was run for 1.5 hrs. A mixture of 46 gms polymeric syntan developed by Kanthimathi et al (from above Example 1 disclosed U.S. patent application Ser. No. 10/618,997) and 230 gms of BCS (Golden Chemicals, Mumbai, India) was added. The drum was run for 3 hrs. The pH of the cross-section of the leather was found to be 4.5. The leathers were washed with 9.2 l of water for 10 minutes. The resulting wet processed leathers were taken from the drum and piled.

Example 3

The present example was disclosed in Indian Patent Application No. Del/770/2000, incorporated herein by reference.

105 gms of sodium meta silicate ($Na_2SiO_3.5H_2O$) were stirred with 303 gms of sodium dichromate in a flask fitted with a stirrer. 550 ml of water were added to the above mass with continuous stirring. 188 ml of 98% sulphuric acid were added slowly to the above reaction mixture. 41 gms of molasses were added to 41 ml of water in a beaker and the resulting mixture was added drop by drop through a dropping funnel to the above mass over a period of 20 minutes with continuous stirring. The temperature of the resulting mixture was noted to be 95° C. A mixture of 40 gms of phthalic acid and 55 gms of sodium tartrate was added to this reaction mixture over a period of 10 minutes. 50 gms of molasses were added to 50 ml of water in a beaker and the resulting mixture was added to the above mass over a period of 30 minutes. A mixture of 43 gms of phthalic acid and 60 gms of sodium tartrate was added to the above mass over a period of 10 minutes. The temperature of the reaction mixture was noted to be 105° C. The stirring was continued for another 2 hrs after the complete addition of the organic ligands. A 10% solution of the above mass was subjected to diphenyl carbazide test, whereby no chromium (VI) could be detected. The reaction mixture thus formed was aged for 12 hrs. The pH of the 1:1 aqueous solution of the above mixture was then checked and was found to be 2.7. This mixture was then filtered through a cloth and the filtrate was spray dried at a temperature of 260° C. with contact time of 3 sec. The resulting powder was stored in a plastic container. This product was used for tanning pickled goat skins at 1.0% metal oxide w/w (weight of metal oxide to weight of pelt) on pelt weight and the resultant leathers were found to have a shrinkage temperature of 109° C., exhibiting an exhaustion of 91 and 90% for silica and chromium respectively. The tanned leathers were subsequently post-tanned to garments using conventional procedure. The resultant leathers were found to be more soft, supple, stretch and smooth with strength characteristics that are comparable to that of conventional chrome tanned leathers.

Example 4

Four bated cow sides having fleshed pelt weight of 25.6 kgs were placed in a small experimental tanning drum. The cross section pH of the bated pelts was found to be 8.0.

The bated pelts were washed with 51.2 liters of water for 10 minutes and drained. A combination of syntans, 512 gms of Basyntan DI (phenolic condensed product from BASF), 256 gms of Vernatan OS (phenolic condensed product from Colour-Chem Ltd.), 256 gms of Basyntan FB6 (urea melamine based product from BASF) and 256 gms of Vernatan RD 35 (acrylic co-polymer based product from Colour-Chem Ltd.) along with 12.8 liters of water was added simultaneously to the drum. The drum was run for 1 hr. To this, 256 gms of Sandopel Brown BSI (acid dye from Clariant) was added. The drum was run for 30 min. To this, a combination of fat liquors, 256 gms of Vernol liquor PN (natural oil based product from Colour-Chem Ltd.), 256 gms of Vernol liquor ASN (synthetic fat liquor from Colour-Chem Ltd.) and 256 gms of Balmol SX-20 (synthetic fat liquor from Balmar Lawrie & Co. Ltd.) in 2560 ml of hot water at 25° C. was added to the drum. The drum was run for 1 hr. 1280 ml of 10% conc. formic acid was added in two installments at an interval of 10 min and the drum was run for 1 hr. The pH of the cross section was 6.0. This was followed by the addition of 1792 gms of chromium-silica tanning agent as developed by Thanikaivelan et al. (from above Example 3). The drum was run for 8 hrs. The tanning was complete and the pH was found to be 4.0. The leathers were washed with 51.2 liters of water for 10 minutes. The resulting wet processed leathers were taken out from the drum and piled.

Example 5

Five bated sheepskin pelts having fleshed pelt weight of 5.6 kgs were degreased conventionally in a small experimental tanning drum. The cross section pH of the degreased pelts was found to be 8.0.

The degreased pelts were washed with 11.2 liters of water for 10 minutes and drained. The pelts were added to the drum along with 5.6 liters of water. The pH of the pelts was adjusted to 6.0 by adding 190 ml of 10% conc. formic acid w/v (weight of formic acid to volume of water) in two installments at an interval of 10 min and the drum was run for 30 min. Basyntan FB6 of 112 gms (urea melamine based product from BASF) were added to the drum. The drum was run for 1 hr. To this, 34 gms of Luganil FBO (acid dye from BASF) were added. The drum was run for 30 minutes. To this, a combination of fat liquors, 56 gms of Vernol liquor SS (semi synthetic fat liquor form Colour-Chem Ltd.), 56 gms of Vernol liquor ASN (synthetic fat liquor from Colour-Chem Ltd.), 56 gms of Balmol SXE (synthetic fat liquor from Balmar Lawrie & Co. Ltd.), 56 gms Balmol LB-20 (synthetic fat liquor from Balmar Lawrie & Co. Ltd.), 56 gms Lipoderm liquor SLW (synthetic fat liquor from BASF) in 560 ml of hot water at 40° C. were added to the drum. The drum was run for 1.5 hrs. This was followed by the addition of 280 gms of BCS. The drum was run for 3 hrs. The pH of the cross-section was 3.8. The leathers were washed with 11.2 liters of water for 10 minutes. The resulting wet processed leathers were taken out from the drum and piled.

Example 6

Four bated buffcalf pelts having a fleshed pelt weight of 26 kgs were placed in a small experimental tanning drum. The cross section pH of the bated pelts was found to be 8.5.

The bated pelts were washed with 52 liters of water for 10 min and drained. A combination of syntans, 260 gms of Basyntan P (phenol condensed product from BASF), 260 gms of Vernatan OS (phenol condensed product from Colour-Chem Ltd.), 260 gms of Basyntan FB6 (urea melamine based product from BASF) and 260 gms of Relugan RE (co-polymer based product from BASF), along with 13 liters of water, was added simultaneously to the drum. The drum was run for 1 hr. To this, a combination of 130 gms of Luganil FBO (acid dye from BASF) and 130 gms of Dermapel blue IDBN (direct dye from Clariant) was added. The drum was run for 30 min. To this, combination of fat liquors, 260 gms of Vernol liquor PN (natural oil based fat liquor from Colour-Chem Ltd.), 260 gms of Vernol liquor ASN (synthetic fat liquor from Colour-Chem Ltd.) and 260 gms of Balmol SX-20 (synthetic fat liquor from Balmar Lawrie & Co. Ltd.) in 2.6 liters of hot water at 50° C. was added to the drum. The drum was run for 1 hr. 5.2 kg of wattle, which is a conventional vegetable tanning agent extracted from wattle bark, was added to the drum. The drum was run for 8 hrs. Then, 780 ml formic acid (10% diluted w/v of formic acid to water) was added in two installments at an interval of 10 min and drumming was continued for 1 hr. The pH of the cross section was 3.5. The leathers were washed with 52 liters of water for 10 minutes. The resulting wet processed leathers were taken out from the drum and piled.

Example 7

Five bated goatskin pelts having fleshed pelt weight of 4.6 kgs were added to a small experimental tanning drum. The cross section pH of the bated pelts was found to be 8.0.

The bated pelts were washed with 9.2 liters of water for 10 minutes and drained. A combination of syntans, 46 gms of Sellasol PR (protein condensate product from Together For Leather (TFL)), 23 gms of Vernatan OS (phenolic condensed product from Colour-Chem Ltd.), 46 gms of Basyntan FB6 (urea melamine based product from BASF) and 46 gms of Relugan RE (co-polymer based product from BASF), along with 2.3 l water, was added simultaneously to the drum. The drum was run for 1 hr. To this, 28 gms of Dermapel blue IDBN (direct dye from Clariant) was added. The drum was run for 30 minutes. To this, 138 gms of Vernol liquor ASN (synthetic fat liquor from Colour-Chem Ltd.) in 460 ml of hot water at 50° C. were added to the drum. The drum was run for 1.5 hrs. Wattle of 690 gms was added to the drum. The drum was run for 2 hrs. Then, 140 ml formic acid (10% diluted) were added in two installments at an interval of 10 min and drumming was continued for 1 hr. The pH of a cross section was 3.5. The leathers were washed with 9.2 liters of water for 10 minutes. The resulting wet processed leathers were taken out from the drum and piled.

Example 8

Four bated cow sides having a fleshed pelt weight of 25.6 kgs were placed in a small experimental tanning drum. The cross section pH of the bated pelts was found to be 8.0.

The bated pelts were washed with 51.2 liters of water for 10 minutes and drained. A combination of syntans, 512 gms of Basyntan DI (phenolic condensed product from BASF), 256 gms of Vernatan OS (phenolic condensed product from Color-Chem Ltd.), 256 gms of Basyntan FB6 (urea melamine based product from BASF) and 256 gms of Relugan RE (co-polymer product from BASF), along with 12.8 liters of water, was added simultaneously to the drum. The drum was run for 1 hr. To this, 256 gms of Luganil FBO (acid dye from BASF) were added. The drum was run for 30 min. To this, 256 gms of Vernol liquor PN (natural oil based fat liquor from Colour-Chem Ltd.), 256 gms of Vernol liquor ASN (synthetic fat liquor from Colour-Chem Ltd.) and 256 gms of Balmol SX-20 (synthetic fat liquor from Balmar Lawrie & Co. Ltd.) in 2560 ml of hot water at 50° C. were added to the drum. The drum was run for 1 hr. 1280 ml of 10% conc. formic acid were added in two installments at the interval of 10 min and drumming was continued for 1 hr. The pH of the cross section was 5.0. This was followed by the addition of 1536 gms of BCS (based on pelt weight) and 256 gms of Relugan RF (acrylic based product from BASF). The drum was run for 8 hrs. The tanning was complete and the pH was found to be 4.0. The leathers were washed with 51.2 liters of water for 10 minutes. The resulting wet processed leathers were taken out from the drum and piled.

Example 9

The present example was disclosed in Indian Patent Application No. Del 88/2002, incorporated herein by reference.

25 gms of naphthalene and 25 ml of conc. sulfuric acid were placed in a 250 ml round bottomed flask fitted with a stirrer. The contents of the flask were heated to 80° C. for 120 minutes with constant stirring. A drop of the resulting mass was added to a beaker and 1 ml water was added to the same with shaking. A clear solution without any naphthalene smell was obtained, confirming the completion of sulfonation. Simultaneously, 0.5 gm salicylic acid was placed in a separate beaker and 0.5 ml concentrated sulfuric acid was added with stirring at 25° C. The slurry was left aside with occasional stirring for 3 hrs. The naphthalene sulfonic acid, prepared in the flask was allowed to cool down to 60° C. and was transferred to a reactor fitted with a thermometer, stirrer and a dropping funnel. The mass was stirred continuously for a period of 10 min. while maintaining the temperature at 60° C. with the help of the thermostat. A mixture of 0.2 gm polyacrylic acid, 0.25 gm phthalic acid, 1 gm citric acid and 0.14 gm salicylic acid was dissolved in 10 ml water in a beaker and the same was added to the reaction mass in the reactor through the dropping funnel. The mixture was heated at 65° C. for 20 min. 250 gms of aluminium sulfate were added to the above mass, along with 100 ml of water with vigorous stirring. The temperature of the bath was gradually raised to 70° C. and heating was continued for another 60 min. The sulfosalicylic acid, which was prepared in the beaker, was added to above mass in the reactor and heating was continued for another 30 minutes. The resultant mixture was transferred to a bucket and the pH was raised to 2.5 by adding 60 gms sodium sulfite dissolved in 100 ml water while continuing stirring. Air was passed through the resulting solution for a period of 70 minutes. The slurry was filtered using muslin cloth having a pore size of 5–10μ. The filtrate was drum dried at 130° C. and the powder was stored in a plastic container.

The product was used for tanning delimed goat skins and added at 1.5% $Al_2O_3$ w/w (weight to weight of pelt). The tanned leather was left overnight and the shrinkage temperature was found to be 85° C. exhibiting 80–82% exhaustion of aluminium.

Example 10

Four bated buff calf pelts having a fleshed pelt weight of 26 kgs were placed in a small experimental tanning drum. The cross section pH of the bated pelts was found to be 8.0.

The bated pelts were washed with 52 liters of water for 10 minutes and drained. A combination of syntans, 520 gms of Basyntan DI (phenolic condensed product from BASF), 260 gms of Vernatan OS (phenolic condensed product from Color-Chem Ltd.), 260 gms of Basyntan FB6 (urea melamine based product from BASF) and 260 gms of Relugan RE (co-polymer based product from BASF), along with 13 liters of water, was added simultaneously to the drum. The drum was run for 1 hr. To this, 260 gms of Luganil FBO (acid dye from BASF) were added. The drum was run for 30 min. To this, a combination of fat liquors, 260 gms of Vernol liquor PN (natural oil based fat liquor from Colour-Chemn Ltd.), 260 gms of Vernol liquor ASN (synthetic fat liquor from Colour-Chem Ltd.) and 260 gms of Balmol SX-20 (synthetic fat liquor from Balmar Lawrie & Co. Ltd.) in 2.6 liters of hot water at 50° C. was added to the drum. The drum was run for 1 hr. This was followed by the addition of 2600 gms of aluminum syntan developed by Kanthimathi et al (from above Example 9). The drum was run for 7 hrs. The pH of the cross section was 4.0. The leathers were washed with 52 liters of water for 10 minutes. The resulting wet processed leathers were taken out of the drum and piled.

Example 11

Five bated sheepskin pelts having fleshed pelt weight of 5.6 kgs were degreased conventionally in a small experimental tanning drum. The cross section pH of the degreased pelts was found to be 8.0.

The degreased pelts were washed with 11.2 liters of water for 10 minutes and drained. The pelts were added to the drum along with 5.6 liters of water. The pH of the pelts was adjusted to 6.0 by adding 190 ml of 10% conc. formic acid in two installments at an interval of 10 min and drumming was continued for 30 min. A combination of fat liquors, 56 gms of Vernol liquor SS (semi synthetic fat liquor form Colour-Chem Ltd.), 56 gms of Vernol liquor ASN (synthetic fat liquor from Colour-Chem Ltd.), 56 gms of Balmol SXE (synthetic fat liquor from Balmar Lawrie & Co. Ltd.), 56 gms Balmol LB-20 (synthetic fat liquor from Balmar Lawrie & Co. Ltd.), 56 gms Lipoderm liquor SLW (synthetic fat liquor from BASF) in 560 ml of hot water at 50° C. was added to the drum. The drum was run for 1 hr. This was followed by the addition of 280 gms of BCS. The drum was run for 3 hrs. The pH of the cross-section was 3.8. The leathers were washed with 11.2 liters of water for 10 minutes. The resulting wet processed leathers were taken out of the drum and piled.

Example 12

Four bated cow grain and splits having a fleshed pelt weight of 25.4 kgs were added to a small experimental tanning drum. The cross section pH of the bated pelts was found to be 8.0. The bated pelts were washed with 50.8 liters of water for 10 minutes and drained. The pelts were added to the drum along with 12.7 liters of water. The pH of the pelts was adjusted to 5.0 by adding 1270 ml of 10% conc. formic acid in two installments at the interval of 10 min and drumming was continued for 30 min. A combination of syntans, 508 gms of Basyntan DI (phenolic condensed product from BASF), 254 gms of Vernatan OS (phenolic condensed product from Color-Chem Ltd.), 254 gms of Basyntan FB6 (urea melamine based product from BASF) and 254 gms of Relugan RE (co-polymer based product from BASF) was added simultaneously to the drum. The drum was run for 1 hr. Then, a combination of 127 gms of Sellafast orange-CGL (metal complex dye from TFL) and 127 gms of Luganil FBO (acid dye from BASF) was added. The drum was run for 30 min. To this, a combination of fat liquors, 254 gms of Vernol liquor PN (natural oil based fat liquor from Colour-Chem Ltd.), 254 gms of Vernol liquor ASN (synthetic fat liquor from Colour-Chem Ltd.) and 254 gms of Balmol SX-20 (synthetic fat liquor from Balmar Lawrie & Co. Ltd.) in 1280 ml of hot water at 50° C. was added to the drum. The drum was run for 1 hr. This was followed by the addition of 1778 gms of BCS (based on pelt weight). The drum was run for 8 hrs. The tanning was complete and the pH was found to be 4.0. The leathers were washed with 50.8 liters water for 10 minutes. The resulting wet processed leathers were taken out of the drum and piled.

The presently disclosed process does not require any complicated control measures. The pickling, basification, acid washing, rechroming and neutralization steps are eliminated. There is a significant reduction in total solids and chemical oxygen demand generated using the process of the present invention in comparison to conventional processes (Table 1). The process also leads to significant reduction in time, power and water (Table 1).

Furthermore, the process produces leathers having comparable softness, smoothness and other bulk properties with conventionally processed leathers (Table 2). Table 2 shows a subjective comparison of various properties of leather produced using the transposed process of the present invention in comparison to leather produced using conventional processes. The properties were rated on a scale from 0–10 points, in a subjective analysis, where higher points indicate better properties.

The present invention is not to be limited in scope by the specific embodiments described herein. Indeed, various modifications of the invention in addition to those described herein will become apparent to those skilled in the art from the foregoing description. Such modifications are intended to fall within the scope of the appended claims. Various references are cited herein, the disclosure of which are incorporated by reference in their entireties.

TABLE 1

Comparison of process requirement, pollution parameters, water, time and power requirement

| Sl. No. | Parameters | Conventional leather processing | Transposed leather processing |
|---|---|---|---|
| 1. | Pickling | Required | Not required |
| 2. | Basification | Required | Not required |
| 3. | Acid washing | Required | Not required |
| 4. | Rechroming | Required | Not required |
| 5. | Neutralization | Required | Not required |
| 6. | Total solids load | 150–350 kg/ton of raw skins/hides | 100–200 kg/ton of raw skins/hides |
| 7. | COD load | 15–25 kg/ton of raw skins/hides | 10–15 kg/ton of raw skins/hides |
| 8. | Time requirement | 5.35–6.95 days | 5.05–5.45 days |
| 9. | Water requirement | 17760–19920 liters/ton of raw skins/hides | 14600–15600 liters/ton of raw skins/hides |
| 10. | Power requirement | 460–1580 kWh | 225–480 kWh |

TABLE 2

Comparison of bulk properties of leathers from conventional (C) and transposed (E) process

| Bulk properties | Conventional process | Transposed process |
|---|---|---|
| Softness | 8 ± 0.5 | 8.2 ± 0.5 |
| Fullness | 8.2 ± 0.5 | 8.2 ± 0.5 |

TABLE 2-continued

Comparison of bulk properties of leathers from conventional (C) and transposed (E) process

| Bulk properties | Conventional process | Transposed process |
|---|---|---|
| Grain smoothness | 8 ± 0.5 | 8.0 ± 0.5 |
| Grain tightness | 8 ± 0.5 | 8.2 ± 0.5 |
| General appearance | 8.2 ± 0.5 | 8.2 ± 0.5 |

Note:
The values are mean S.D. of ten leathers

We claim:

1. A transposed process for making a wet processed leather, said process comprising:

(a) treating an untanned pelt, which has been delimed and/or bated, with fat liquor at a pH in the range of 5.0–8.5 and at a temperature in the range of about 20–55° C., wherein the fat liquor is present in the range of 2–6% w/w (weight of fat liquor to weight of pelt);

(b) stirring the product of step (a) for a period of about 3 hrs to obtain a fat liquored pelt;

(c) mixing a tanning agent at a pH in the range of 5.0–8.5 in the fat liquored pelt of step (b), wherein the tanning agent is present in the range of 4–25% w/w (weight of tanning agent to weight of pelt); and (d) adjusting the product of step (c) to obtain a pH in a range of 3.5–4.5 in about 3 hrs to obtain a wet processed leather.

2. The process of claim 1, further comprising adding a synthetic tanning agent and a dye are added to the fat liquor in step (a) prior to stirring in the (b), wherein the synthetic tanning agent is present in the range of 1–6% w/w (weight of synthetic tanning agent to weight of pelt).

3. The process of claim 2, wherein the synthetic tanning agent is selected from group of acrylic, phenol condensates, urea condensates, sulfones, melamine, and protein condensates.

4. The process of claim 2, wherein the dye is an acid and/or a metal complex.

5. The process of claim 1, wherein the fat liquor is selected from the group consisting of vegetable fat liquors, synthetic fat liquors, and semisynthetic fat liquors.

6. The process of claim 1, wherein the tanning agent of step (c) is selected from the group consisting of basic chromium sulfate, vegetable tannin, aluminum syntan and chromium-silica.

7. The process of claim 1, wherein the amount of fat liquor is based on the weight of fleshed pelt.

8. The process of claim 1, wherein the amount of tanning agent is based on the weight of the fleshed pelt.

9. The process of claim 2, wherein the dye is present in about 2% w/w (weight of dye to weight of pelt).

10. The process of claim 2, wherein the dye is present in about 1% w/w (weight of dye to weight of pelt).

11. The process of claim 1, wherein the process is performed in about 6–10 hrs.

12. The process of claim 1, wherein the process generates a COD load in environment in the range of 10–15 kg/ton of pelt.

13. The process of claim 1, wherein the pelt has not been subjected to pickling, basification, acid washing, rechroming, and neutralization steps.

14. The process of claim 1, wherein the process, including treatment of the pelt prior to fatliquoring, is completed within about 5 days.

15. The process of claim 1, wherein water is used in the process in the amount of the range of 15000–16000 liter/ton of pelt.

16. The process of claim 1, wherein the process requires power in the range of 220–500 kWh.

* * * * *